United States Patent [19]

Gaupp et al.

[11] 3,992,318

[45] Nov. 16, 1976

[54] CORROSION INHIBITOR

[75] Inventors: Raymond H. Gaupp, Whitehouse Station; John A. Nygren, Jr., Parsippany, both of N.J.

[73] Assignee: Drew Chemical Corporation, Parsippany, N.J.

[22] Filed: Oct. 9, 1973

[21] Appl. No.: 404,256

[52] U.S. Cl. ..... 252/389 A; 21/2.7 A; 252/181

[51] Int. Cl.[2] ..... C23F 11/16; C02B 5/06

[58] Field of Search ..... 252/389 A, 388, 389 R, 252/390, 180, 181; 21/2.7 A, 2.7 R

[56] References Cited

UNITED STATES PATENTS

| | | | |
|---|---|---|---|
| 3,336,221 | 8/1967 | Ralston et al. | 252/8.55 B X |
| 3,620,667 | 11/1971 | Zimmie | 21/2.7 |
| 3,630,938 | 12/1971 | Troscinski | 252/389 A |
| 3,699,048 | 10/1972 | Krueger et al. | 252/180 |
| 3,751,372 | 8/1973 | Zecher | 252/181 |

*Primary Examiner*—Benjamin R. Padgett
*Assistant Examiner*—David Leland
*Attorney, Agent, or Firm*—Marn & Jangarathis

[57] ABSTRACT

A corrosion inhibitor which is comprised of a polyphosphate; a phosphonic acid or salt thereof; and a polymer of acrylic or methacrylic acid. The corrosion inhibitor is employed in aqueous systems and is capable of operating at a wide variety of conditions, including high temperature, high pH and in the presence of contaminants such as hydrogen sulfide and hydrocarbons. A typical composition is comprised of sodium hexametaphosphate, sodium salt of amino tri(methylene-phosphonic acid) and polyacrylic acid.

10 Claims, No Drawings

CORROSION INHIBITOR

This invention relates to corrosion inhibition, and more particularly, to a new and improved corrosion inhibiting composition which is particularly suitable for aqueous systems.

There are a wide variety of corrosion inhibiting compositions available in the market, and in general, such compositions effectively prevent corrosion in aqueous systems at normal operating conditions. In systems, however, which are operated at high temperatures and/or high pH and/or in the presence of contaminants, such as, hydrocarbons and/or hydrogen sulfide, the corrosion inhibiting compositions which are available in the market are generally not effective under such conditions. Accordingly, there is a need for new and improved corrosion inhibiting compositions which are capable of operating at the wide variety of conditions which may be encountered in a processing system.

An object of the present invention is to provide a new and improved corrosion inhibiting composition.

Another object of the present invention is to provide for improved corrosion inhibition in aqueous systems.

A further object of the present invention is to provide a new and improved process for inhibiting corrosion at a wide variety of conditions which may be encountered in a processing system.

These and other objects of the present invention should be more readily apparent from reading the following detailed description of the invention.

In accordance with the present invention, there is provided a corrosion inhibiting composition which includes corrosion inhibiting amounts of the following components:

a. at least one water soluble phosphonic acid or salt thereof;

b. at least one water soluble polyphosphate or alkali metal phosphate; and c. at least one water soluble polymer of acrylic acid and/or methylacrylic acid.

As used herein the term "water soluble" means that the compound is soluble in the amount required for corrosion inhibition. Accordingly, the compound can be sparingly soluble in water so long as the compound is sufficiently water soluble to provide, in solution, a corrosion inhibiting amount thereof.

The term "corrosion inhibiting amount" as used herein means that the component is present in an amount such that the composition inhibits corrosion and maintains such corrosion inhibition in an aqueous system.

A corrosion inhibiting composition including the hereinabove described components has been found to be effective at the wide variety of conditions which could be encountered in a processing system, including high temperatures and/or high pH and/or in the presence of contaminants such as, hydrocarbons and/or hydrogen sulfide, which may be present in such systems.

The phosphonic acid or salt thereof component of the present invention is a compound characterized by the following group

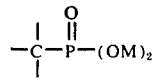

wherein each M is independently either hydrogen or a cation; e.g., a metal ion, including alkali metals, such as sodium, lithium and potassium, alkaline earth metals, such as calcium and magnesium, aluminum, zinc, cadmium, and manganese; nickel, cobalt, cerium; lead, tin; iron, chromium and mercury; an ammonium ion; or an alkyl ammonium ion derived from amines having a low molecular weight, such as below 300, and more particularly, the alkyl amines, alkylene amines and alkanol amines containing no more than two amine groups, such as ethyl amine, diethyl amine, propyl amine, propylene diamine, hexyl amine, 2-ethylhexylamine, N-butylethanol amine, triethanol amine and the like. The preferred cations are those which renders the compound water soluble, with M preferably being ammonium or an alkali metal, in particular sodium.

It is to be understood that as used herein the term "phosphonic acid" generically includes the phosphonic acid and the salts thereof.

As one type of phosphonic acid suitable for the purposes of the present invention, there may be mentioned the aminomethylene phosphonic acids which are characterized by the following grouping:

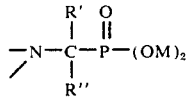

wherein M is as hereinabove defined and R′ and R″ are each individually hydrogen or hydrocarbon (preferably $C_1 - C_5$ alkyl).

The aminomethylene phosphonic acids are preferably characterized by the following structural formula:

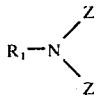

wherein Z is

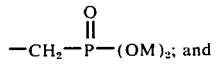

$R_1$ is a. Z (b) 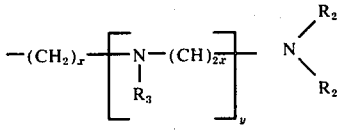

wherein each $R_2$ is independently either Z, hydrogen, $$-CH_2-\overset{O}{\overset{\|}{C}}-OM$$

or $CH_2CH_2OH$ and $R_3$ is either hydrogen, Z or $C_1-C_{20}$ alkyl.

$x$ is 1 to 20

$y$ is 0 to 18 and total of $x+y$ is no more than 20.

(c) $$-(CH_2)_v-\underset{R_5}{\underset{|}{CH}}-\underset{R_6}{\underset{|}{CH}}-(CH_2)_w-N\begin{matrix}Z\\ \\ R_7\end{matrix}$$

wherein $R_5$ is hydrogen or hydroxyl;

$R_6$ is hydrogen or alkyl, preferably an alkyl group containing 1 to 6 carbon atoms and $R_5$ and $R_6$ together with the two carbon atoms to which they are attached can form a cycloalkyl ring, preferably having from 4 to 6 carbon atoms.

$v$ is 0 to 20;

$w$ is 0 to 20, — and the total of $v+w$ is no more than 20;

$R_7$ is hydrogen or Z;

(d) $$-(CH_2)_m-S-(CH_2)_n-N\begin{matrix}Z\\ \\ Z\end{matrix}$$

wherein $m$ and $n$ are each 1 to 3.

(e) $$-\left[C_2H_4-\underset{Z}{N}\right]_q-Z$$

wherein $q$ is 1 to 20.

f. — $R_8(OR_9)_r(OR_{10})$ wherein $R_8$ is $C_3-C_5$ alkylene $R_9$ is $C_2-C_5$ alkylene $R_{10}$ is $C_1-C_5$ alkyl $r$ is 1–20

As a further type of aminomethylene phosphonic acid, there may be mentioned the silicon containing amino methylene phosphonic acids, as described in U.S. Pat. No. 3,716,569 which is hereby incorporated by reference. These compounds are N-methyl phosphonic acid derivatives of the following compounds.

$$(R_{11}O)_3Si-A-\overset{H}{\overset{|}{N}}-B$$

and polymers and copolymers thereof; wherein $R_{11}$ is hydrocarbon group, preferably lower alkyl ($C_1-C_5$), B is hydrogen, hydrocarbon or $$-[A-\overset{H}{\overset{|}{N}}]_t-R_{12}$$

wherein $R_{12}$ is hydrogen or hydrocarbon, $t$ is 1–20, A is an alkylene group of $C_1-C_{10}$;

and wherein at least one of the available nitrogen hydrogens is substituted with $$-CH_2-\overset{O}{\overset{\|}{P}}(OM)_2$$

wherein M is as hereinabove defined.

As still another type of aminomethylene phosphonic acid, there may be mentioned the nitrogen-heterocyclic phosphonic acids characterized by aminomethylene phosphonic acids bonded directly or indirectly to the nitrogen atom of the heterocyclic ring, as disclosed in U.S. Pat. No. 3,674,804 which is hereby incorporated by reference. These compounds are characterized by the following structural formula:

$$N-(R'NH_b)_d-[CH_2-\overset{O}{\overset{\|}{P}}-(OM)_2]_c$$

wherein N is a heterocyclic ring including nitrogen, —R′ is $C_1-C_5$ hydrocarbon, $b$ is 0 or 1, and $c$ is 1 or 2 and $c+b$ is 2; and $d$ is 0 or 1, and when $d$ is 0, $c$ is 1; and M is as hereinabove defined.

As another type of phosphonic acid which is suitable for the purposes of the present invention, there may be mentioned the ethane diphosphonic acids. The ethane diphosphonic acids are characterized by the following structural formula:

$$H_n-\underset{R_9}{\underset{|}{C}}-\underset{R_{10}}{\underset{|}{C}}\begin{matrix}\overset{O}{\overset{\|}{P}}-(OM)_2\\ \\ \overset{O}{\overset{\|}{P}}-(OM)_2\end{matrix}$$

wherein M is as defined previously; $n$ is 1 or 2 to provide the required number of hydrogen atoms;

$R_9$ is either hydrogen, alkyl (preferably containing 1 to 4 carbon atoms), oxygen, halogen, hydroxy, cyano, — $N(R_{11})_2$ wherein $R_{11}$ is hydrogen or alkyl containing 1–30 carbon atoms; $XR_{12}$ wherein X is sulfur or oxygen and $R_{12}$ is alkyl containing 1–30 carbon atoms, preferably 1–4 carbon atoms; phenyl; benzyl; acetoxy; $SO_3R_{11}$ wherein $R_{11}$ is as above; benzoyl; $CO_2H$ and $CH(COOR_{11})_2$ wherein $R_{11}$ is as defined above;

$R_{10}$ is as above except for oxygen and alkyl, and $R_{10}$ is hydrogen when $R_9$ is oxygen;

and one of $R_9$ and $R_{10}$ is hydroxy, except that when $R_9$ is oxygen $R_{10}$ is hydrogen.

The ethane diphosphonic acids are disclosed in U.S. Pat. No. 3,644,151 which is hereby incorporated by reference.

As representative examples of phosphonic acids which are preferably employed in the corrosion inhibiting composition of the present invention, there may be mentioned:

ethane - 1 - hydroxy - 1, 1 - diphosphonic acid, amino tri (methylene phosphonic acid), ethylene diamine tetra (methylene phosphonic acid), hexamethylene diamine tetra (methylene phosphonic acid); and the water soluble salts thereof.

The phosphate components of the composition of the present invention may be any one of the wide variety of water soluble inorganic polyphosphates which are known in the art or an alkali metal phosphate. In general, the polyphosphates include an alkali metal oxide and/or alkaline earth metal oxide and/or a zinc oxide in a ratio to $P_2O_5$ of from about 0.4:1 to about 2:1, with sodium and potassium oxide being preferred. The polyphosphate may also be in acid form, with the water to $P_2O_5$ ratio being from about 0.4:1 to 2:1. Suitable water-soluble inorganic polyphosphates include, for example, all water-soluble glassy and crystalline phosphates; i.e., the so-called molecularly hydrated phosphates of alkali metals, alkaline earth metals and zinc, as well as zinc-alkali metal phosphates and mixtures thereof. The acids corresponding to these salts, such as pyrophosphoric ($H_4P_2O_7$) and higher phosphoric acids are also suitable. Examples of especially suitable polyphosphates are:

| | |
|---|---|
| Sodium Tripolyphosphate | [$Na_5-P_3O_{10}$] |
| Sodium Acid Pyrophosphate | [$Na_2H_2P_2O_7$] |
| Glassy Phosphates | [$(Na\ P\ O_3)_x$ x=6, 13, 21] |
| Tetrasodium Pyrophosphate | [$Na_4P_2O_7$] |
| Potassium Tripolyphosphate | [$K_5P_3O_{10}$] |
| Tetrapotassium Pyrophosphate | [$K_4P_2O_7$] and the like, |

with sodium hexametaphosphate being most preferred.

The third component of the composition is a water soluble polymer of acrylic or methacrylic acid, and the term "polymer," as used herein, includes both homopolymers and copolymers, with the term "copolymer" including copolymers formed from two or more monomers and also including random, block, and graft copolymers. As representative examples of polymers of acrylic acid and methacrylic acid, there may be mentioned: the homopolymer of acrylic acid; the homopolymer of methacrylic acid; the copolymer of acrylic acid and methacrylic acid; a copolymer of acrylic acid and/or methacrylic acid with other polymerizable ethylenically unsaturated monomers, such as, crotonic acid, maleic acid or its anhydride, vinyl sulfonic acid, vinyl phosphonic acid, vinyl acetate, ethyl vinyl ether, acrylamide, ethyl acrylate, ethyl methacrylate, methacrylonitrile; graft polymers of a polysaccharide as potato starch, corn starch, and other starches, starch ethers, water soluble cellulose ethers, modified starches obtained by treating starch with acids or with oxidizing agents at a temperature below the gelatinization temperature, or starch degradation products which are soluble in cold water and are obtained by treating an aqueous starch suspension with an oxidizing agent at a temperature up to 100° C., or dextrins produced, for instance, by treating starch with acids followed by heating to a temperature above 150° C. or by roasting starch at 180°–200° C. These polymers are described in U.S. Pat. No. 3,699,048 and British Patent No. 1,234,320 which are hereby incorporated by reference. The polymer generally has a number average molecular weight from about 500 to 1,000,000 and preferably from about 1000 to about 20,000.

The three components of the composition of the present invention are incorporated therein in corrosion inhibiting amounts; i.e., the three components are present in the composition in an amount which is effective to prevent corrosion upon addition of the composition to a system subject to corrosion. In general, the weight ratio of phosphonate to phosphate (calculated as $PO_4$) in the composition ranges from about 0.1:1 to about 10:1, and preferably from about 0.5:1 to about 3:1. In general, the polymer of acrylic and/or methacrylic acid is present in the composition in a polymer to phosphate (calculated as $PO_4$) ratio of from about 0.01:1 to about 10:1 and preferably in an amount from about 1.1:1 to about 1:1, all by weight. It is to be understood that although the hereinabove described amounts of components employed in the composition of the present invention are preferred, the overall scope of the invention is not limited to such amounts. The choice of optimum amounts of the various components is deemed to be within the scope of those skilled in the art from the teachings herein.

The composition of the present invention, including the hereinabove described three components, is generally employed in combination with a liquid vehicle, preferably water. It is to be understood, however, that the composition can also be employed in solid form, or the components can be individually added to the aqueous system. In general, the composition is employed using water as a vehicle, with the components being added to water to provide a concentration of the three components in the water from about 1 to about 80%, and preferably from about 10% to about 40%, all by weight. The composition may also include other water treatment components, such as, defoamers, dispersents, biocides, etc. and accordingly, the addition of such components is within the spirit and scope of the present invention.

The composition of the present invention containing corrosion inhibiting amounts of the hereinabove described three components is added to a system subject to corrosion in a corrosion inhibiting amount; i.e., in an amount which is effective to prevent corrosion in the system. This amount will vary depending upon the system to which the composition is added and is influenced by factors, such as area subject to corrosion, processing conditions (pH, temperature), water quantity, etc. In general, the composition of the present invention is added to the system to provide at least 1 ppm of the phosphate component, and preferably from about 5 to about 25 ppm of the phosphate component. In general, the phosphate component is not added in an amount in excess of about 50 ppm. (The phosphate content is in parts by weight, calculated as $PO_4$).

The corrosion inhibitor of the present invention is generally and preferably employed in aqueous systems in which corrosion is a problem, and in particular, in aqueous cooling systems. The overall scope of the invention, however, is not limited to such uses, and other uses should be apparent from the teachings herein.

The composition of the present invention has been found to be effective at a wide variety of conditions encountered in a process and in particular the composition is effective at temperatures at which other compositions have generally not been effective such as temperatures in excess of 60° C. Similarly, the composition is also effective for inhibiting corrosion at a high pH; e.g., in excess of 8.0 or 8.5, as well as lower pH values. In addition, the composition is effective for inhibiting corrosion in the presence of contaminants, such as $H_2S$ and hydrocarbons.

The present invention will be further described with respect to the following examples, but it is to be understood that the scope of the invention is not to be limited thereby. Unless otherwise specified, all parts and percentages are by weight.

EXAMPLE I

The following Compositions A through I below were evaluated for their corrosion inhibiting efficacy as follows:

| | | | |
|---|---|---|---|
| A. | 10 | parts | tetrapotassium pyrophosphate |
| | 10.2 | parts | amino tris methylenephosphonic acid, potassium salt |
| | 9.8 | parts | copolymer of acrylic acid and methacrylic acid in the proportion 2:1 |
| | 70 | parts | water |
| B. | 17 | parts | tetrapotassium pyrophosphate |
| | 13 | parts | ethane-1-hydroxy-1, 1-diphosphonic acid, sodium salt |
| | 5 | parts | polyacrylic acid |
| | 65 | parts | water |
| C. | 15 | parts | sodium tripolyphosphate |
| | 25 | parts | hexamethylenediamine tetra (methylenephosphonic acid), sodium salt |
| | 1 | part | polymethacrylic acid |
| | 59 | parts | water |
| D. | 5.7 | parts | sodium hexametaphosphate |
| | 14.3 | parts | ethylenediamine tetra (methylenephosphonic acid), alkanolamine salt |
| | 10 | parts | acrylic acid/vinyl sulfonic acid copolymer in the proportion 2:1 |
| | 70 | parts | water |
| E. | 5.5 | parts | disodium dihydrogen pyrophosphate |
| | 10.4 | parts | epoxyethane-1, 1-diphosphonic acid, sodium salt |
| | 4.6 | parts | acrylic acid/crotonic acid copolymer in the proportion 2:1 |
| | 79.5 | parts | water |
| F. | 20.2 | parts | potassium tripolyphosphate |
| | 9.8 | parts | 2-sulfo-1-hydroxyethane-1,1-diphosphonic acid, potassium salt |
| | 5 | parts | acrylic acid/acrylamide copolymer in the proporation 1:5 |
| | 65 | parts | water |
| G. | 10.7 | parts | sodium hexametaphosphate |
| | 4.3 | parts | diethyl-2-methyl-1, 2-dihydroisoquinoline-1-phosphonate, sodium salt |
| | 15 | parts | methacrylic acid/vinyl acetate copolymer in the proportion 2:1 |
| | 70 | parts | water |
| H. | 5 | parts | sodium tripolyphosphate |
| | 5 | parts | pentamethylenehexamine octakis (methyl-phosphonic acid), sodium salt |
| | 10 | parts | copolymer of acrylic acid and vinyl phosphonic acid in the proportion 2:1 |
| | 80 | parts | water |
| I. | 20 | parts | sodium hexametaphosphate |
| | 8 | parts | nitrilo tris-methylenephosphonic acid, sodium salt |
| | 1.7 | parts | polyacrylic acid |
| | 70.3 | parts | water |

A quantity of each composition, equivalent to 25 ppm based on solids content of each composition, was added to 22 liters of "synthetic cooling water" having the following analysis:

| Constituent | as | ppm |
|---|---|---|
| Calcium | $CaCO_3$ | 300 |
| Magnesium | $CaCO_3$ | 100 |
| Chloride | $Cl^-$ | 500 |
| Sulfate | $SO_4^=$ | 500 |
| Copper | Cu | 0.2 |
| Iron | Fe | 0.5 |
| Total Alkalinity | $CaCO_3$ | 30 |

The treated water was then circulated, via centrifugal pump, through the annulus of a glass jacketed, single-tube heat exchanger, then through a chilling coil and returned to a holding reservoir. Around the core tube of the heat exchanger were fitted precision machined, cylindrical, mild steel (SAE 1010) metal specimens.

Hot silicone heat-transfer fluid was circulated through the core tube of the heat exchanger by means of an auxiliary recirculating system.

Thermoregulators were employed to maintain the inlet temperature of the silicone fluid to the heat exchanger at 350°±2° F. and the inlet temperature of the water to the heat exchanger at 125°±2° F. Water and silicone fluid flow rate were controlled by rotameter at some point in the 1–15 gpm range.

The precleaned and weighed metal specimens are exposed to the solution for a period of 72 hours after which they are removed, cleaned and reweighed. % corrosion inhibition is determined by comparing the metal specimen weight loss per unit exposed surface area to a similar value obtained when an untreated synthetic cooling water is exposed to the mild steel specimens under identical conditions.

The results of these experiments are shown in Table I.

Table I.

Corrosion inhibiting efficacy in standard "synthetic cooling water"

| Treatment Composition | Treatment level (Total solids basis) | % Corrosion inhibition |
|---|---|---|
| No treatment | 0 | 0 |
| A | 25 ppm | 90 |
| B | 25 ppm | 95 |
| C | 25 ppm | 92 |
| D | 25 ppm | 92 |
| E | 25 ppm | 89 |
| F | 25 ppm | 96 |
| G | 25 ppm | 90 |
| H | 25 ppm | 91 |
| I | 25 ppm | 99 |

EXAMPLE II

Compositions A through I were evaluated using a procedure similar to that explained in Example I with the exception that a residual concentration of 2 ppm hydrogen sulfide was maintained in the synthetic cooling water throughout the duration of each experiment.

The results of these experiments are shown in Table II.

Table II.

Corrosion inhibiting efficacy in standard "synthetic cooling water" containing a residual concentration of 2 ppm hydrogen sulfide.

| Treatment Composition | Treatment level (total solids basis) | % Corrosion Inhibition |
|---|---|---|
| No treatment | 0 | 0 |
| A | 25 ppm | 88 |
| B | 25 ppm | 94 |
| C | 25 ppm | 90 |
| D | 25 ppm | 89 |
| E | 25 ppm | 85 |
| F | 25 ppm | 95 |
| G | 25 ppm | 88 |
| H | 25 ppm | 88 |
| I | 25 ppm | 97 |

EXAMPLE III

Composition A through I were evaluated using a procedure similar to that explained in Example I with the exception that a concentration of 75 ppm mixed aliphatic and aromatic hydrocarbons was maintained in the synthetic cooling water throughout the duration of each experiment.

The results of these experiments are shown in Table III.

Table III.

Corrosion inhibiting efficacy in standard "synthetic cooling water" containing 75 ppm mixed hydrocarbon contaminants.

| Treatment Composition | Treatment level (total solids basis) | % Corrosion Inhibition |
|---|---|---|
| No treatment | 0 | 0 |
| A | 25 ppm | 89 |
| B | 25 ppm | 95 |
| C | 25 ppm | 90 |
| D | 25 ppm | 90 |
| E | 25 ppm | 85 |
| F | 25 ppm | 95 |
| G | 25 ppm | 90 |
| H | 25 ppm | 89 |
| I | 25 ppm | 98 |

The corrosion inhibiting composition of the present invention is particularly advantageous in that the composition is capable of inhibiting corrosion at a wide variety of conditions encountered in a processing system subject to corrosion, including, high pH and/or high temperature and/or in the presence of contaminants. In addition, unlike prior art corrosion inhibiting compositions which have included polyphosphates, there is essentially no scale formation resulating from decomposition of the polyphosphate to an orthophosphate. Accordingly, the present composition does not suffer from the disadvantage primarily associated with the use of polyphosphates in a corrosion inhibiting system. These and other advantages should be apparent to those skilled in the art from the teachings herein.

Numerous modifications and variations of the present invention are possible in light of the above teachings, and, therefore, within the scope of the appended claims the invention may be practised otherwise than as particularly described.

What is claimed is:

1. A corrosion inhibiting composition comprising:

a. at least one water soluble phosphonic acid or salt thereof, selected from the group consisting of ethane-1-hydroxy-1, 1-diphosphonic acid, and amino tri(methylene phosphonic acid);

b. at least one water soluble phosphate selected from the group consisting of sodium hexametaphosphate and tetrapotassium pyrophosphate;

c. at least one water soluble acrylic acid polymer, said components (a), (b) and (c) being present in an amount effective to inhibit corrosion in aqueous systems.

2. A process for inhibiting corrosion in aqueous systems comprising:

dissolving in the aqueous system a corrosion inhibiting amount of (a) at least one phosphonic acid or salt thereof, selected from the group consisting of ethane-1-hydroxy-1, 1-diphosphonic acid and amino tri(methylene phosphonic acid); (b) at least one water soluble phosphate selected from the group consisting of sodium hexametaphosphate and tetrapotassium pyrophosphate; and (c) at least one water soluble polymer of acrylic acid.

3. The composition of claim 1 wherein the weight ratio of component (a) to component (b) both calculated as $PO_4$ is from 0.1:1 to about 10:1 and the weight ratio of component (c) to component (b) calculated as $PO_4$ is from about 0.01:1 to about 10:1.

4. The composition of claim 3 wherein component (c) is a homopolymer of acrylic acid.

5. The composition of claim 4 wherein component (b) is sodium hexametaphosphate.

6. The process of claim 2 wherein said component (b) is dissolved in the aqueous system in an amount from about 1 ppm to about 50 ppm and the weight ratio of component (a) to component (b) both calculated as $PO_4$ is from 0.1:1 to about 10:1 and the weight ratio of component (c) to component (b), calculated as $PO_4$ is from about 0.01 to about 10:1.

7. The process of claim 6 wherein component (c) is a homopolymer of acrylic acid.

8. The process of claim 7 wherein component (b) is sodium hexametaphosphate.

9. The composition of claim 5 wherein component (a) is amino tri(methylene phosphonic acid).

10. The process of claim 8 wherein component (a) is amino tri(methylene phosphonic acid).

* * * * *